US006334322B2

(12) United States Patent
Kubota et al.

(10) Patent No.: US 6,334,322 B2
(45) Date of Patent: Jan. 1, 2002

(54) EXPANSION VALVE FOR REFRIGERATING CYCLE

(75) Inventors: Atsushi Kubota, Tochigi; Nobuo Ichimura, Gunma; Yoshitoshi Noda; Katsunori Fujiura, both of Tochigi, all of (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 09/837,485

(22) Filed: Apr. 19, 2001

(30) Foreign Application Priority Data

Apr. 26, 2000 (JP) ..... 12-126450

(51) Int. Cl.[7] ..... F25B 41/06
(52) U.S. Cl. ..... 62/204; 62/222; 62/228.3
(58) Field of Search ..... 62/210, 211, 212, 62/215, 203, 204, 228.3, 228.5, 222, 223, 224, 225

(56) References Cited

U.S. PATENT DOCUMENTS 3,367,130 A * 2/1968 Owens ..... 62/222
3,875,757 A 4/1975 Amano ..... 62/115
3,952,535 A 4/1976 Putman ..... 62/222
4,261,180 A * 4/1981 Nozawa et al. ..... 62/222 X
5,752,391 A * 5/1998 Ozaki et al. ..... 62/228.3 X
6,105,680 A * 8/2000 Yokomachi et al. ..... 62/228.3
6,212,893 B1 * 4/2001 Ban et al. ..... 62/228.3 X

FOREIGN PATENT DOCUMENTS

EP 1 069 385 1/2001
WO WO 00/37838 6/2000

* cited by examiner

*Primary Examiner*—Harry B. Tanner
(74) *Attorney, Agent, or Firm*—Foley & Lardner

(57) ABSTRACT

A refrigerating cycle has a condenser, an evaporator, a variable displacement compressor, and an expansion valve. The variable displacement compressor is connected between the condenser and the evaporator to form the refrigerating cycle, and includes a control valve designed to provide a control valve characteristic sloping downward with increase in a discharge pressure. The expansion valve is connected between the condenser and the evaporator, to return a refrigerant from the condenser through the evaporator to the variable displacement compressor, and designed to provide an open valve characteristic whose slope is approximately equal to the downward slope of the control valve characteristic.

11 Claims, 6 Drawing Sheets

EXPANSION VALVE FOR REFRIGERATING CYCLE

BACKGROUND OF THE INVENTION

The present invention relates to an expansion valve for a refrigerating cycle which is suitable for an air conditioning system for a motor vehicle.

Generally, the air conditioning system for the motor vehicle is constituted of the refrigerating cycle in which a refrigerant discharged from a compressor is returned to the compressor by way of a condenser, the expansion valve and an evaporator.

The expansion valve is so designed as to control super heat by evaporation temperature at an outlet of the evaporator and a pressure (low pressure) at the outlet of the evaporator. Thereby, the expansion valve is so made as to be free from being influenced by any high pressure which may cause a disturbance.

As is seen in FIG. 7, the expansion valve shows an open valve characteristic TXV which features substantially a horizontal graph. In other words, the open valve characteristic TXV is not dependent on the high pressure.

The open valve characteristic TXV of the expansion valve in FIG. 7 is obtained at an evaporator outlet temperature Te of 0° C. In FIG. 7, the ordinate is an evaporator outlet pressure Pe (more specifically, $Pe_{out}$), while the abscissa is a discharge pressure Pd. There is defined an expansion valve closed zone on substantially an upper side of the open valve characteristic TXV. Contrary to this, there is defined an expansion valve open zone on substantially a lower side of the open valve characteristic TXV. Moreover, as is seen in FIG. 7, on substantially a left side and substantially a right side of an operation area B, there are defined, respectively, a first non-operation area A-1 and a second non-operation area A-2, in each of which the compressor does not operate.

Furthermore, FIG. 7 shows a control valve characteristic C/V featuring a downward slope in accordance with the discharge pressure Pd which gets higher gradually. The control valve characteristic C/V is the one that is obtained when a variable displacement compressor equipped with a control valve is combined with the expansion valve that is set at the open valve characteristic TXV featuring the substantially horizontal graph. In the expansion valve closed zone, there is caused an interfered control area "d" as is depicted by diagonal lines in FIG. 7.

Failures such as hunting and the like may occur, for example, under the following three conditions combined: 1. The expansion valve is set at 5 kg/cm2G (namely, in the interfered control area "d"). 2. Being in the expansion valve closed zone. 3. The compressor is likely to pull the refrigerant forcibly.

In order to prevent such failures from occurring, there is provided one possible solution, that is, to make the control valve characteristic C/V non-linear so that the interfered control area "d" does not occur up to an intersection point P. However, such solution complicates the constitution of the control valve characteristic C/V.

For preventing, with ease, the interfered control area "d" from occurring, the open valve characteristic TXV of the expansion valve is set higher than the control valve characteristic C/V, as is depicted by a dashed line in FIG. 7. In this case, however, the valve opening of the expansion valve gets large when the discharge pressure is high (high load applied) since the control valve characteristic C/V is included in the expansion valve open zone.

When the valve opening of the expansion valve gets large, the refrigerant flowrate will increase. Thereby, it becomes impossible to take the proper super heat, and the refrigerating power is deteriorated. Simultaneously with this, consumption (power) of the variable displacement compressor is increased, thus ending up an increase in cost (not preferable).

SUMMARY OF THE INVENTION

It is, therefore, an object of the present invention to provide an expansion valve for a refrigerating cycle for solving the above mentioned problems.

According to a first aspect of the present invention, there is provided a refrigerating cycle comprising a condenser, an evaporator, a variable displacement compressor, and an expansion valve. The variable displacement compressor is connected between the condenser and the evaporator to form the refrigerating cycle, and comprises a control valve designed to provide a control valve characteristic sloping downward with increase in a discharge pressure. The expansion valve is connected between the condenser and the evaporator, to return a refrigerant from the condenser through the evaporator to the variable displacement compressor, and designed to provide an open valve characteristic whose slope is approximately equal to the downward slope of the control valve characteristic.

According to one of a second aspect and a third aspect of the present invention, there is provided a refrigerating cycle comprising a condenser, an evaporator, a variable displacement compressor, and an expansion valve. The variable displacement compressor is connected between the condenser and the evaporator to form the refrigerating cycle, and comprises a control valve designed to provide a control valve characteristic sloping downward with increase in a discharge pressure. Furthermore, the variable displacement compressor is adapted to operate in an operation area defined between a first non-operation area and a second non-operation area opposite to the first non-operation area, the second non-operation area defining the discharge pressure higher than the discharge pressure that is defined in the operation area. The expansion valve is connected between the condenser and the evaporator, to return a refrigerant from the condenser through the evaporator to the variable displacement compressor, and designed to provide an open valve characteristic which intersects, at an intersection point defined in one of the first non-operation area and the second non-operation area of the variable displacement compressor, with the control valve characteristic of the control valve.

DETAILED DESCRIPTION OF THE PREFERRED EMBODIMENT

As is seen in FIG. 1 through FIG. 4, there is provided an expansion valve 5 for a refrigerating cycle and data related thereto, according to a first preferred embodiment of the present invention.

Figure 2:
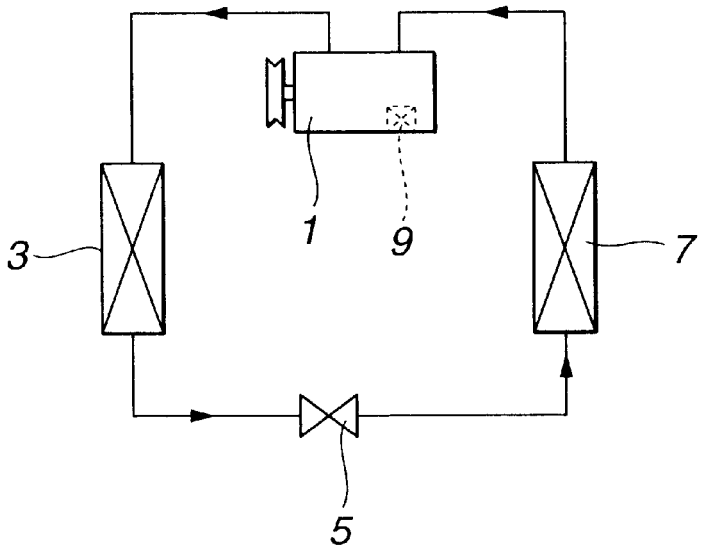
FIG. 2 is a block diagram of a refrigerating cycle.

As is seen in FIG. 2, there is provided the refrigerating cycle of an air conditioning system for a motor vehicle. A refrigerant is discharged from a variable displacement compressor 1, and is then returned to the variable displacement compressor 1 by way of a condenser 3, the expansion valve 5 and an evaporator 7.

A control valve 9 is built in the variable displacement compressor 1. When being combined with the expansion valve 5 (to be mentioned afterwards), the variable displacement compressor 1 (control valve 9) shows a control valve characteristic C/V as is seen in FIG. 1.

Figure 1:
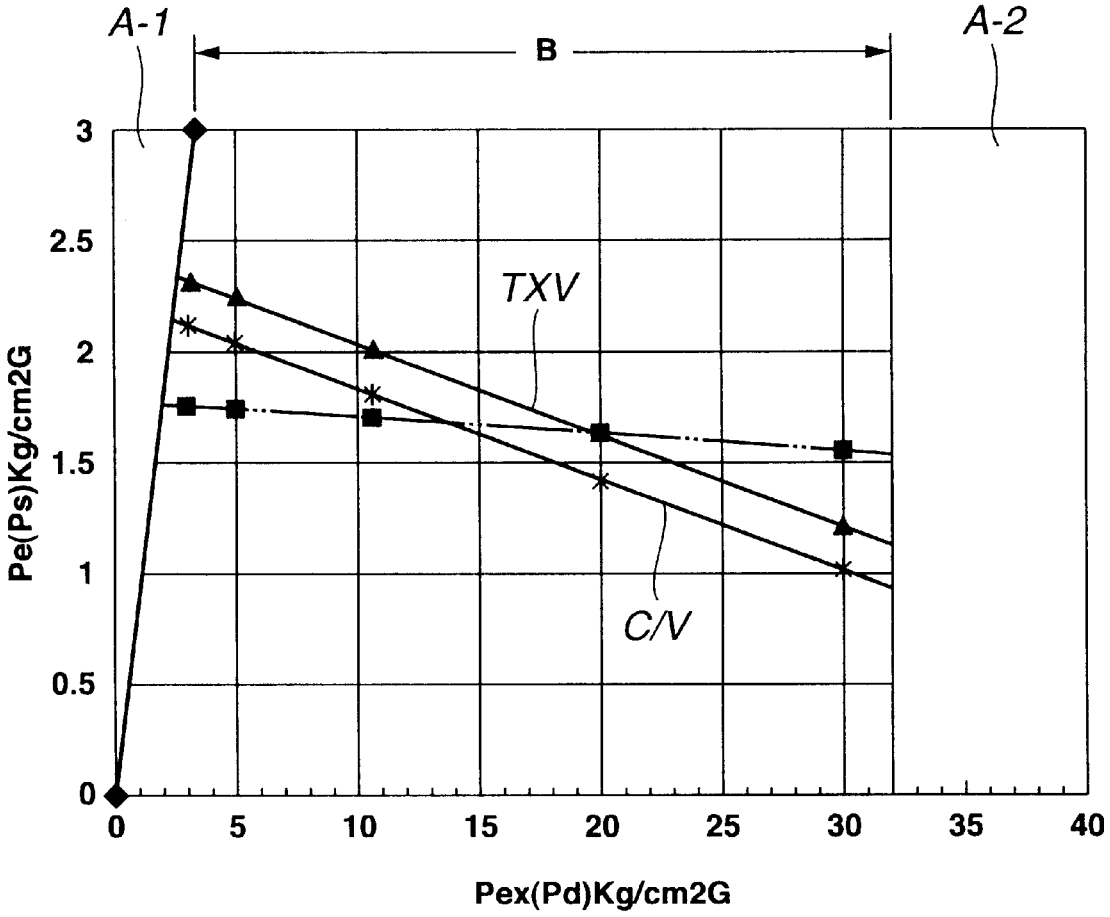
FIG. 1 is a graph showing an open valve characteristic TXV of an expansion valve 5, and a control valve characteristic C/V of a variable displacement compressor 1, according to a first preferred embodiment of the present invention.

In FIG. 1, the ordinate is a suction pressure Ps (or an evaporator outlet pressure $Pe_{out}$), while the abscissa is a discharge pressure Pd (or an expansion valve inlet pressure Pex). The variable displacement compressor 1 operates in an operation area B. There is defined a first intersection zone A-1 substantially on a left side of the operation area B in FIG. 1. In the first intersection zone A-1, the suction pressure Ps (low pressure) is equal to the discharge pressure Pd (high pressure), to thereby make the variable displacement compressor 1 stay at rest (not operating). There is provided a second intersection zone A-2 substantially on a right side of the operation area B in FIG. 1. In the second intersection zone A-2, the discharge pressure Pd is so high as to disengage a clutch, to thereby make the variable displacement compressor 1 stay at rest (not operating). This summarizes that the first intersection zone A-1 disposed substantially on the left side of the operation area B in FIG. 1 is defined as a first non-operation area A-1, while the second intersection zone A-2 disposed substantially on the right side of the operation area B in FIG. 1 is defined as a second non-operation area A-2.

Figure 3:
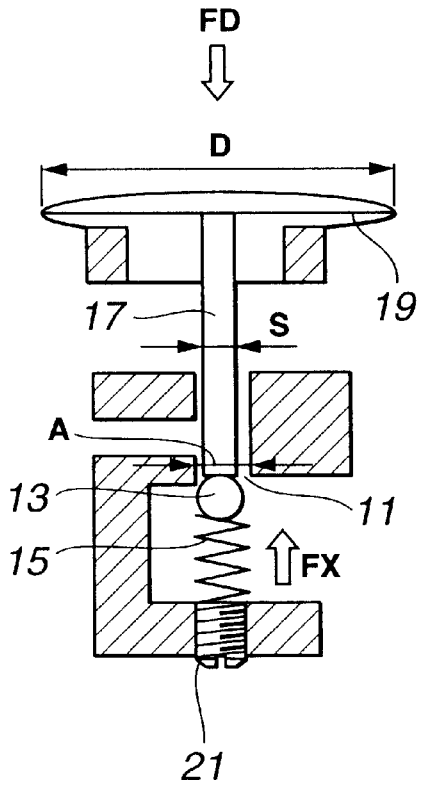
FIG. 3 is a schematic diagram of the expansion valve 5.

As is seen in FIG. 3, the expansion valve 5 has a port 11, and a ball valve 13 for controlling a port area A of the port 11. A spring pressure is applied upwardly to the ball valve 13 from an energizing spring 15, while a diaphragm pressure is applied downwardly to the ball valve 13 from a diaphragm 19 by way of a shaft 17. The spring pressure of the energizing spring 15 is arbitrarily adjustable by using an adjusting measure 21 such as screw and the like. The diaphragm pressure is variable according to pressure and temperature of a refrigerant at an outlet of the evaporator 7. Then, a differential pressure between the spring pressure and the diaphragm pressure contributes toward obtaining a variable set value of the expansion valve 5.

As is seen in FIG. 1, the expansion valve 5 combined with the variable displacement compressor 1 shows an open valve characteristic TXV that has substantially the same slope as that of the control valve characteristic C/V.

The open valve characteristic TXV of the expansion valve 5 in FIG. 1 is a control characteristic when an evaporator outlet temperature Te of the refrigerant at an outlet of the evaporator 7 is 0° C.

Namely, the open valve characteristic TXV having substantially the same slope as that of the control valve characteristic C/V as is seen in FIG. 1 can be obtained by increasing the port 11 in diameter or by decreasing the diaphragm 19 in diameter.

More specifically, the following expressions are obtained using an effective diameter D of the diaphragm 19, a diaphragm pressure PD, a shaft area S, the port area A, a spring constant K (of the energizing spring 15), a lift X (an extent that the ball valve 13 is lifted), a load FD applied to the diaphragm 19, and a load FX applied to the ball valve 13:

[Math 1]

$$FX=\{A\cdot Pex-(A-S)\cdot Pe_{in}\}+K\cdot X$$

$$FD=D\cdot(PD-Pe_{out})-S\cdot(Pe_{in}-Pe_{out}) \quad (1)$$

where $Pe_{in}$ is an evaporator inlet pressure, and $Pe_{out}$ is an evaporator outlet pressure.

In the expression (1) above, FX=FD (equilibrium). Thereby, the following expression (2) is obtained:

[Math 2]

$$\{A\cdot Pex-(A-S)\cdot Pe_{in}\}+K\cdot X=D\cdot PD'Pe_{out})-S\cdot(Pe_{in}-Pe_{out}) \quad (2)$$

When $Pe_{in}=Pe_{out}$, the following expression (3) is obtained:

[Math 3]

$$\{A\cdot Pex-(A-S-D)\cdot Pe_{in}\}+K\cdot X=D\cdot PD(A-S-D)\cdot Pe_{in}=A\cdot Pex-D\cdot PD+K\cdot X \quad (3)$$

Thus, the following expression (4) is obtained:

[Math 4]

$$Pe=A/(A-S-D)\cdot Pex-D/(A-S-D)\cdot PD+K\cdot X/(A-S-D) \quad (4)$$

where A/(A−S−D) is a valve opening (high pressure dependent), (A−S−D). PD is a slope of the set value corresponding to temperature, and (A−S−D) is a set value of the spring adjustment by the energizing spring 15.

With the expressions above, it is evident that increasing the port area A of the port 11 or decreasing the effective diameter D of the diaphragm 19 contributes toward allowing, with ease, the open valve characteristic TXV to have substantially the same slope as that of the control valve characteristic C/V.

Figure 4:
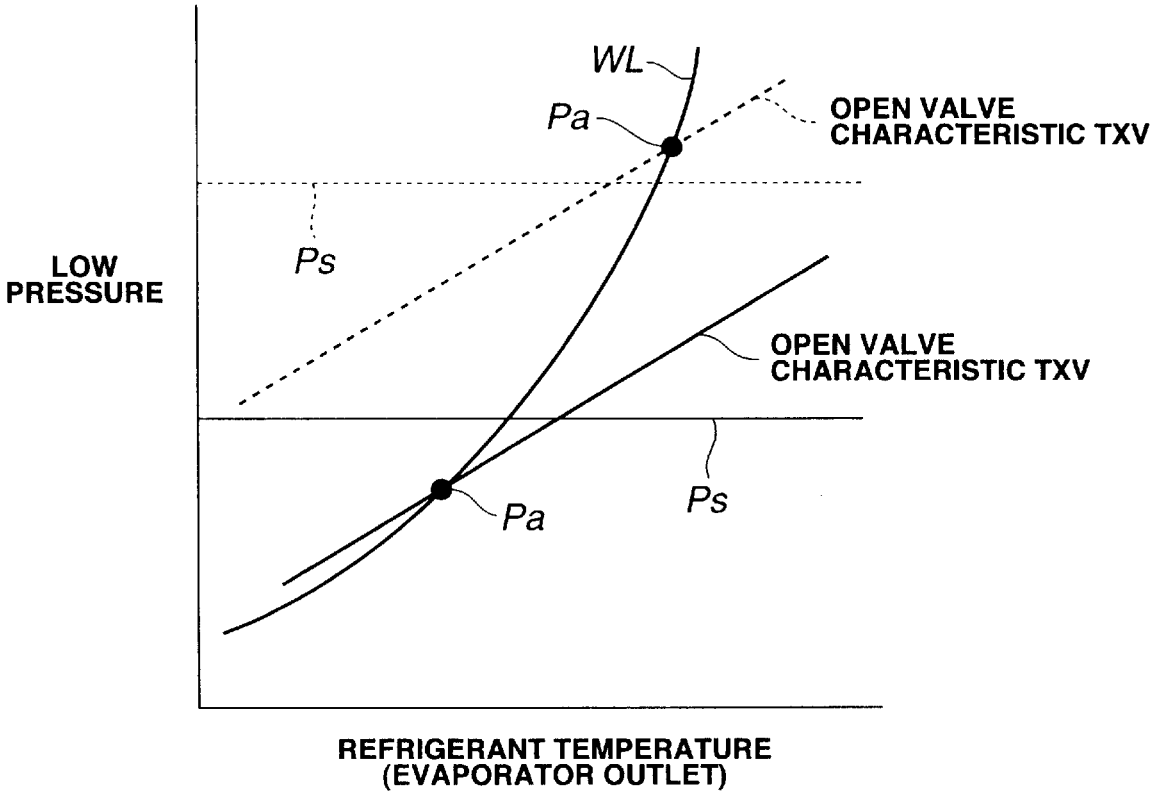
FIG. 4 is a graph showing an intersection point pressure Pa relative to a pressure control line.

In this case, a relation of the open valve characteristic TXV of the expansion valve 5 relative to the control valve characteristic C/V of the control valve 9 is described below. As is seen in FIG. 4, the ordinate is a low pressure, while the abscissa is a temperature of the refrigerant (at the outlet of the evaporator 7). In order to take a proper super heat, an intersection point pressure Pa (where a refrigerant saturation line WL intersects with the open valve characteristic TXV of the expansion valve 5) is defined, in the following manner, with respect to a control line (the suction pressure Ps) of the variable displacement compressor 1:

The intersection point pressure Pa is set at a pressure not greater than the suction pressure Ps during an operation mode when the refrigerating power is prioritized (see continuous line in FIG. 4). Contrary to this, the intersection point pressure Pa is set at a pressure not less than the suction pressure Ps during a saving mode (see dashed line in FIG. 4).

With the expansion valve 5 for the refrigerating cycle thus constituted, the control valve characteristic C/V does not intersect with the open valve characteristic TXV, to thereby prevent an interfered control area "d" from occurring which is responsible for failures such as hunting and the like.

In addition, when a high load is applied, the set value of the expansion valve 5 is lowered, to thereby cause a preferable valve opening (likely to be restricted). The thus obtained preferable valve opening contributes toward causing the proper super heat, to thereby improve the refrigerating power. Simultaneously with this, the refrigerant flowrate is reduced, to thereby improve a saving mode of the variable displacement compressor 1.

On the other hand, when a low load is applied, the valve opening is likely to be open. The thus obtained valve opening contributes toward causing a proper super heat, and a proper refrigerant flowrate is obtained throughout the entire area of the evaporator 7. Thereby, the evaporator 7 is improved in terms of temperature characteristic (no deviation in temperature distribution), and an effective refrigeration is achieved.

Figure 5:
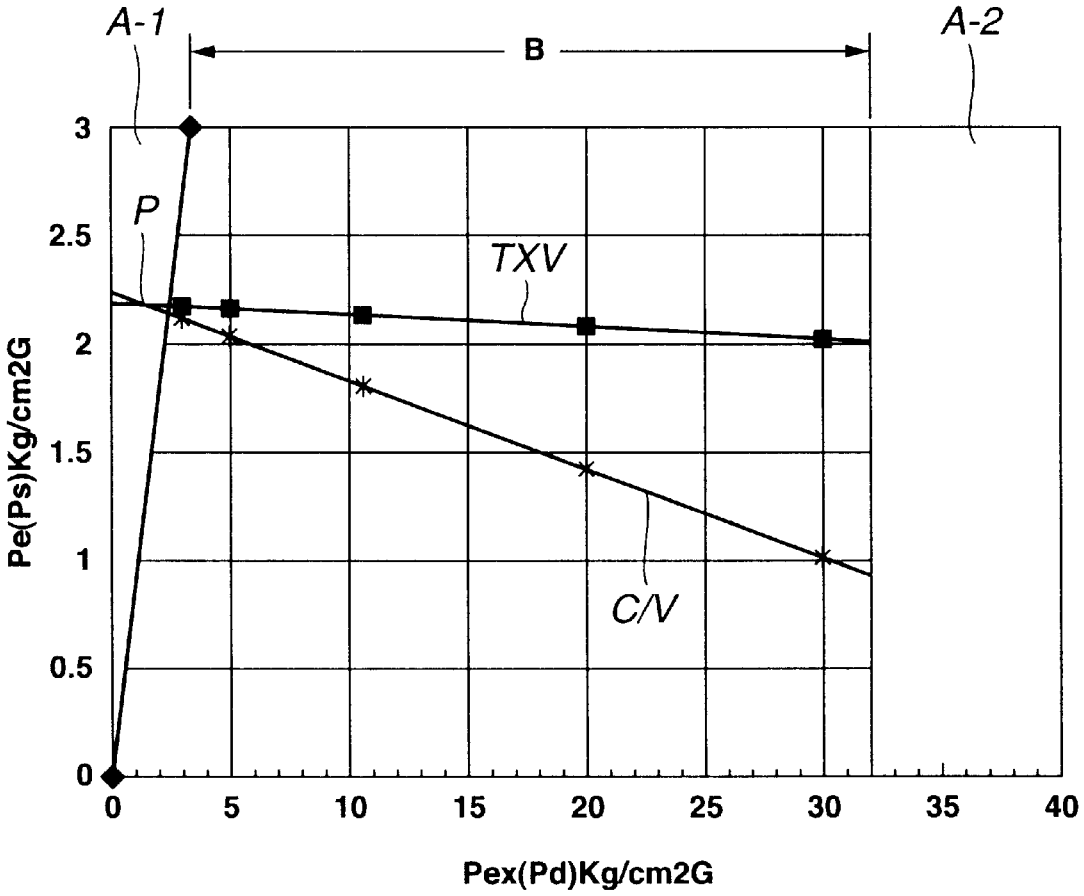
FIG. 5 is a graph showing an intersection point P (the open valve characteristic TXV intersecting with the control valve characteristic C/V) disposed in a first non-operation area A-1, according to a second preferred embodiment of the present invention.

As is seen in FIG. 5, there is provided a graph showing the open valve characteristic TXV of the expansion valve 5, and the control valve characteristic C/V of the control valve 9 built in the variable displacement compressor 1, according to a second preferred embodiment of the present invention.

The open valve characteristic TXV of the expansion valve 5 features substantially a horizontal graph, by restricting constantly the port area A of the port 11. Thereby, the open valve characteristic TXV is small in terms of dependency on high pressure. Contrary to this, the control valve characteristic C/V features a downward slope toward higher pressure, in other words, the downward slope in accordance with the discharge pressure Pd which gets higher gradually. In the second preferred embodiment, the intersection point P is set in the first intersection zone A-1 (or the first non-operation area A-1) that is out of the operation area B, to thereby prevent failures from occurring such as hunting and the like.

Figure 6:
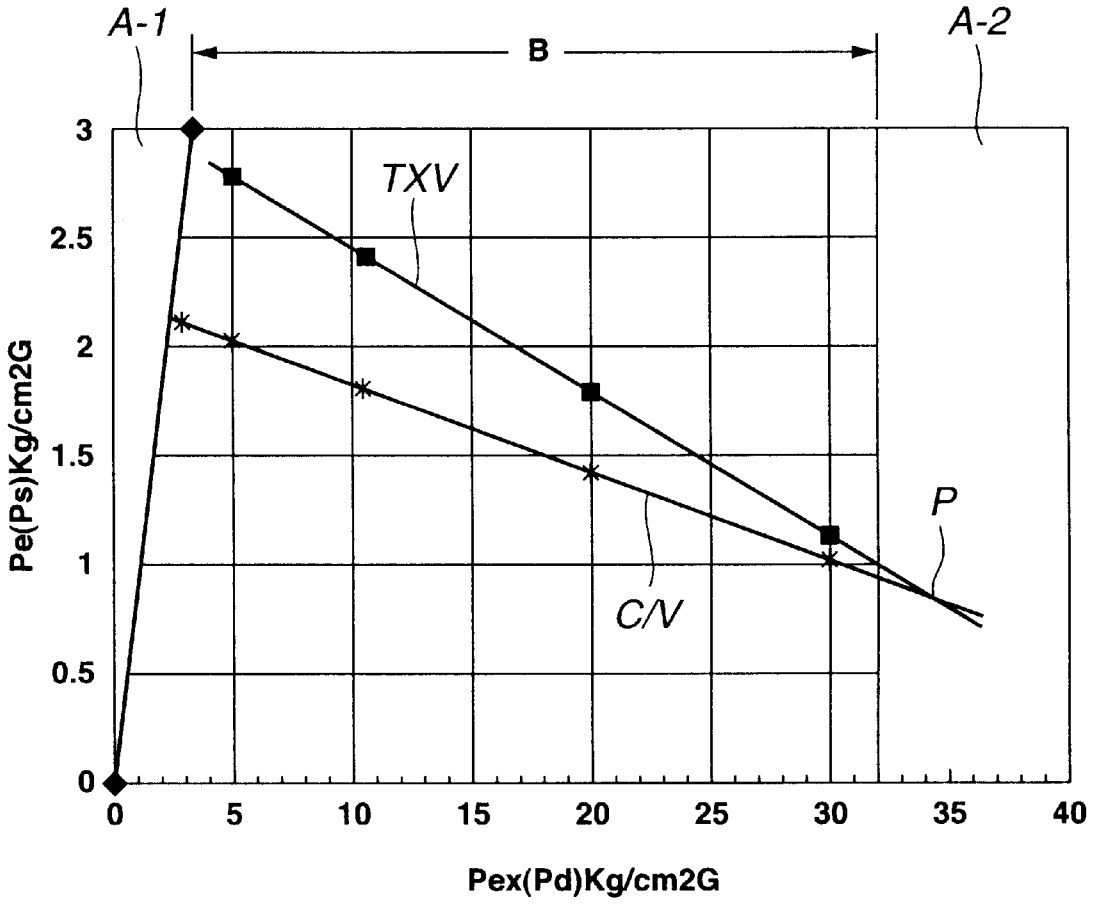
FIG. 6 is a graph showing the intersection point P disposed in a second nonoperation area A-2, according to a third preferred embodiment of the present invention.
Figure 7:
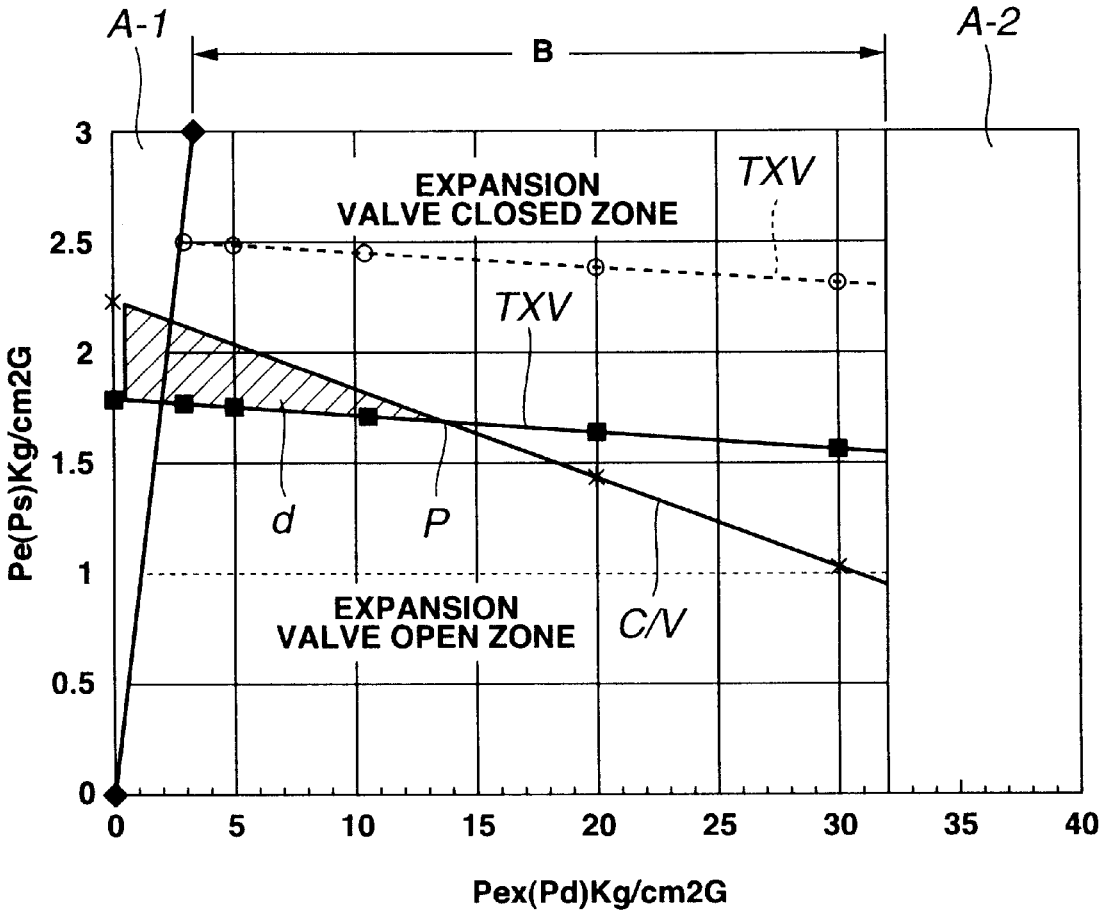
FIG. 7 (similar to FIG. 1) is a graph showing an open valve characteristic TXV of an expansion valve and a control valve characteristic C/V of a variable displacement compressor, according to a related art.

Moreover, as is seen in FIG. 6, there is provided a graph showing the open valve characteristic TXV of the expansion valve 5, and the control valve characteristic C/V of the control valve 9 built in the variable displacement compressor 1, according to a third preferred embodiment of the present invention.

The open valve characteristic TXV features a downward slope toward higher pressure, by increasing the port area A of the port 11. On the other hand, the control valve characteristic C/V also features a downward slope toward high pressure, in other words, the downward slope in accordance with the discharge pressure Pd which gets higher gradually. In addition, the open valve characteristic TXV is not parallel relative to the control valve characteristic C/V. In the third preferred embodiment, the intersection point P is set in the second intersection zone A-2 (or the second non-operation area A-2) that is out of the operation area B, to thereby prevent failures from occurring such as hunting and the like.

What is claimed is:

1. A refrigerating cycle comprising:

a condenser;

an evaporator;

a variable displacement compressor connected between the condenser and the evaporator to form the refrigerating cycle, the variable displacement compressor comprising a control valve designed to provide a control valve characteristic sloping downward with increase in a discharge pressure; and an expansion valve connected between the condenser and the evaporator, to return a refrigerant from the condenser through the evaporator to the variable displacement compressor, and designed to provide an open valve characteristic whose slope is approximately equal to the downward slope of the control valve characteristic.

2. The refrigerating cycle as claimed in claim 1, in which the control valve characteristic of the control valve is a relationship between the discharge pressure on an outlet side of the variable displacement compressor and a suction pressure on an inlet side of the variable displacement compressor, while the open valve characteristic of the expansion valve is a relationship between an inlet pressure on an inlet side of the expansion valve and an outlet pressure on an outlet side of the expansion valve, and in which the variable displacement compressor is adapted to operate in an operation area.

3. The refrigerating cycle as claimed in claim 2, in which the expansion valve comprises a port defining a port area, and the expansion valve further comprises a diaphragm defining a diameter, and in which at least one of the port area and the diameter is so sized that the open valve characteristic of the expansion valve is higher than the control valve characteristic of the control valve of the variable displacement compressor.

4. The refrigerating cycle as claimed in claim 3, in which the port area of the port of the expansion valve is increased so as to allow the expansion valve to provide the open valve characteristic whose slope is approximately equal to the downward slope of the control valve characteristic of the control valve.

5. The refrigerating cycle as claimed in claim 3, in which the diameter of the diaphragm of the expansion valve is decreased so as to allow the expansion valve to provide the open valve characteristic whose slope is approximately equal to the downward slope of the control valve characteristic of the control valve.

6. A refrigerating cycle comprising:

a condenser;

an evaporator;

a variable displacement compressor connected between the condenser and the evaporator to form the refrigerating cycle, the variable displacement compressor comprising a control valve designed to provide a control valve characteristic sloping downward with increase in a discharge pressure, the variable displacement compressor being adapted to operate in an operation area defined between a first non-operation area and a second non-operation area opposite to the first non-operation area, the second non-operation area defining the discharge pressure higher than the discharge pressure that is defined in the operation area; and an expansion valve connected between the condenser and the evaporator, to return a refrigerant from the condenser through the evaporator to the variable displacement compressor, and designed to provide an open valve characteristic which intersects, at an intersection point defined in one of the first non-operation area and the second non-operation area of the variable displacement compressor, with the control valve characteristic of the control valve.

7. The refrigerating cycle as claimed in claim 6, in which the control valve characteristic of the control valve is a relationship between the discharge pressure on an outlet side of the variable displacement compressor and a suction pressure on an inlet side of the variable displacement compressor, while the open valve characteristic of the expansion valve is a relationship between an inlet pressure on an inlet side of the expansion valve and an outlet pressure on an outlet side of the expansion valve.

8. The refrigerating cycle as claimed in claim 7, in which the expansion valve comprises a port defining a port area, the port area being restricted constantly so as to allow the expansion valve to provide the open valve characteristic whose slope is less inclined than the downward slope of the control valve characteristic of the control valve.

9. The refrigerating cycle as claimed in claim 8, in which the open valve characteristic of the expansion valve and the control valve characteristic of the control valve intersect with each other at the intersection point defined in the first non-operation area.

10. The refrigerating cycle as claimed in claim 7, in which the expansion valve comprises a port defining a port area, the port area being increased so as to allow the expansion valve to provide the open valve characteristic whose slope is more inclined than the downward slope of the control valve characteristic of the control valve.

11. The refrigerating cycle as claimed in claim 10, in which the open valve characteristic of the expansion valve and the control valve characteristic of the control valve intersect with each other at the intersection point defined in the second non-operation area.

* * * * *